US005482490A

United States Patent [19]

Weldon-Ming

[11] Patent Number: 5,482,490

[45] Date of Patent: Jan. 9, 1996

[54] COLLAPSIBLE DOLL'S HOUSE

[76] Inventor: Richard S. Weldon-Ming, 101 Waterfall Ave., Craighall, Johannesburg, Transvaal, South Africa

[21] Appl. No.: 160,819

[22] Filed: Dec. 3, 1993

[30] Foreign Application Priority Data

Dec. 4, 1992 [ZA] South Africa ..... 92/9430

[51] Int. Cl.[6] ..... A63H 33/16

[52] U.S. Cl. ..... 446/75; 446/80; 446/109; 446/478

[58] Field of Search ..... 446/75, 80, 108, 446/109, 115, 116, 476, 478, 487

[56] References Cited

U.S. PATENT DOCUMENTS

| | | | |
|---|---|---|---|
| 1,567,849 | 12/1925 | Kliner | 446/75 |
| 1,569,066 | 1/1926 | Beiger | 446/108 |
| 1,756,526 | 4/1930 | Thompson | 446/75 |
| 2,104,628 | 1/1938 | Warren | 446/75 |
| 2,217,374 | 10/1940 | Menzel | 446/75 |
| 2,441,076 | 5/1948 | Makrianes | 446/75 |
| 4,094,090 | 6/1978 | Walmer | 446/110 |
| 4,964,249 | 10/1990 | Payne | 446/75 |
| 5,120,262 | 6/1992 | Caine | 446/75 |

FOREIGN PATENT DOCUMENTS

| | | | |
|---|---|---|---|
| 354706 | 7/1961 | Switzerland | 446/109 |
| 588518 | 6/1947 | United Kingdom | 446/109 |
| 596518 | 1/1948 | United Kingdom | 446/478 |

OTHER PUBLICATIONS

"Self Storing Doll House", Popular Mechanics, Nov. 1962, pp. 158, 159.

*Primary Examiner*—Robert A. Hafer
*Assistant Examiner*—Jeffrey D. Carlson
*Attorney, Agent, or Firm*—Burns, Doane, Swecker & Mathis

[57] ABSTRACT

A doll's house comprises a plurality of separable components including walls, a floor, a roof, and internal dividing partitions, each component being separable from the other components, and foldable into a collapsed configuration. Two of the components form the base and top of an elongate rectangular box and the other components, when collapsed, are sufficiently compact to fit within the box. The floor forms the base of the box and has upstanding flanges around its periphery and the walls, when in their erected condition are being located inside of the upstanding flange and are held there. The roof comprises a pitched part which is collapsible into a flat form, and a lid adapted to locate over and support the upper edge of the walls when in their erected condition. The lid has a downwardly extending flange which extends around the upper edges of the walls when in their erected condition. The floor and the lid have a groove defined around the periphery thereof just inside of their respective flanges and the upper and lower edges of the walls locate in those respective grooves to be frictionally held therein and thereby rigidify the erected structure.

3 Claims, 2 Drawing Sheets

COLLAPSIBLE DOLL' S HOUSE

BACKGROUND TO THE INVENTION

This invention relates to a collapsible doll's house. The term "doll's house" will include within its scope other miniature structures such as a shop, fire station, garage or the like.

Doll's houses have been popular children's toys for many centuries. Generally a doll's house will have an opening from through which a child playing with the toy can view a number of different rooms within the doll's house. Each of the rooms will be decorated and furnished differently to represent the different rooms within a house. One problem with prior art doll's houses is that they tend to be cumbersome. Where a child's room is small or is shared with siblings, the doll's house occupies a considerable amount of floor space, and this can be undesirable. As a consequence, many doll's houses are relatively small which has meant that only small dolls and furnishings can be employed within the house.

SUMMARY OF THE INVENTION

According to the invention there is provided a doll's house comprising a plurality of separable components including walls, a floor, a roof, and internal dividing partitions, each component being separable from the other components, and at least some of the components being foldable into a collapsed configuration.

Preferably, two of the components form the base and top of an elongate rectangular box and the other components, when collapsed, are sufficiently compact to fit within the box.

In a preferred arrangement the floor is in the form of the base of the box and has upstanding flanges around its periphery, the walls, when in their erected condition, being located inside of the upstanding flange and are held within that upstanding flange. The roof is preferably formed in two components, that is, a pitched part which is collapsible into a flat form and a lid which is adapted to locate over and support the upper edge of the walls when in their erected condition. The lid part preferably has a downwardly extending flange which extends around the upper edges of the walls when in their erected condition. Preferably, both the floor and the lid part have a groove defined around the periphery thereof just inside of their respective flanges and the upper and lower edges of the walls are adapted to locate in those respective grooves to be frictionally held therein and thereby rigidify the erected structure.

The internal partitions preferably comprise a horizontal panel adapted to define a floor between upper and lower stories and a vertical panel adapted to divide each floor into two rooms. One of the internal partitions may have a slot therethrough, through which slot the other internal partitions are adapted to pass. The floor and lid part may each have a central groove formed therein to receive the lower and upper ends of the vertical partition.

An embodiment of the invention is described below with reference to the attached drawings.

DETAILED DESCRIPTION

Figure 1:
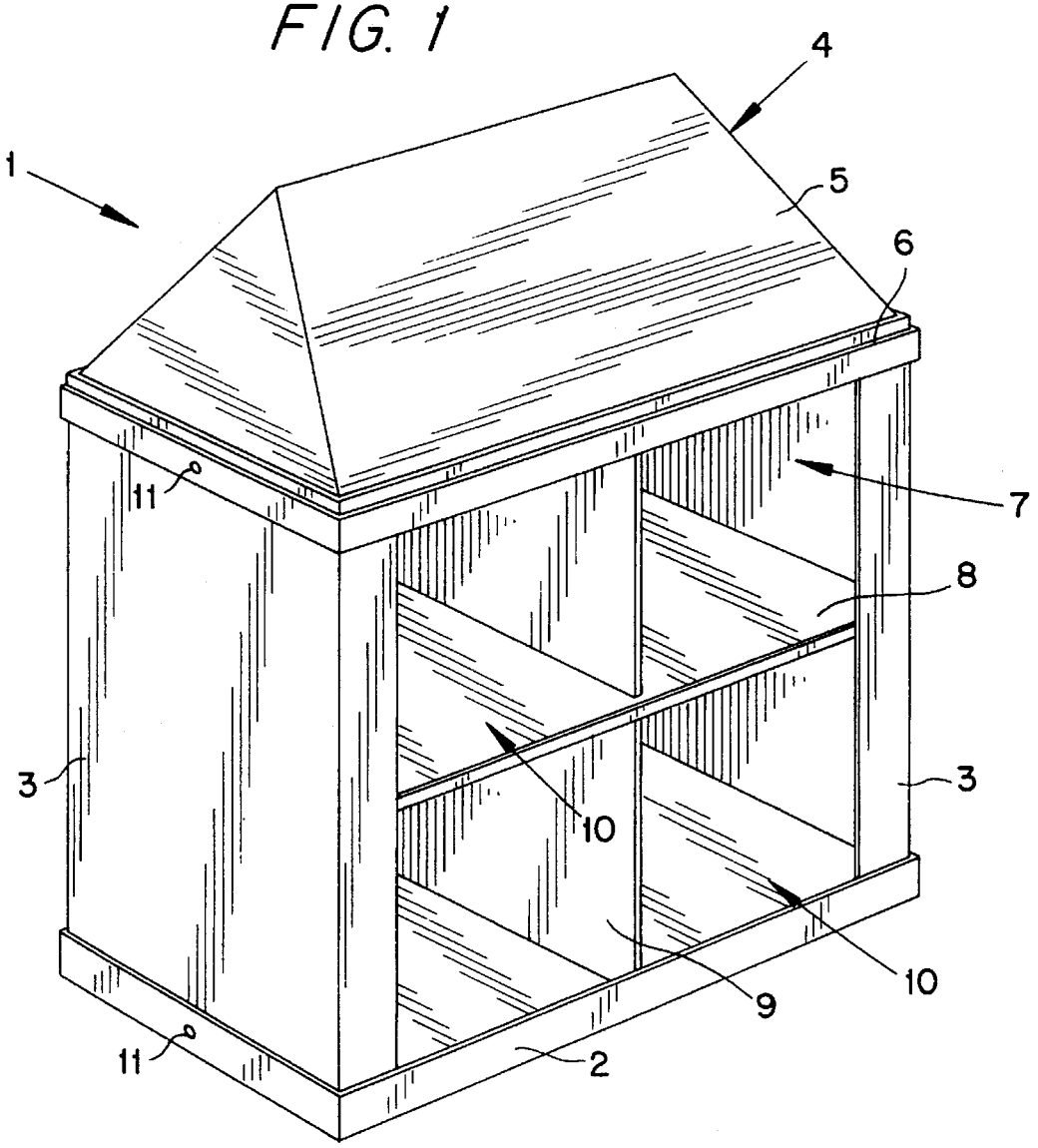
FIG. 1 shows a perspective view of a doll's house according to the invention in its erected condition.

Referring initially to FIG. 1, a doll's house 1 is shown comprising a base 2, side walls 3, a roof 4 which is comprised of a pitched part 5 and a lid 6. The lid 6 also constitutes a ceiling panel in that an underside thereof defines a ceiling for rooms located therebeneath. An interior 7 of the house is divided into four equally sized rooms 10 by a horizontal partition 8 and a vertical partition 9. Each of the rooms 10 will be individually decorated so that, for example, one room may be decorated as a bathroom, another as a bedroom, and so forth. For other structure types other decoration will be applied to the walls. The structure in its erected condition may be fixed together by bolts 11 or other fasteners.

Figure 2:
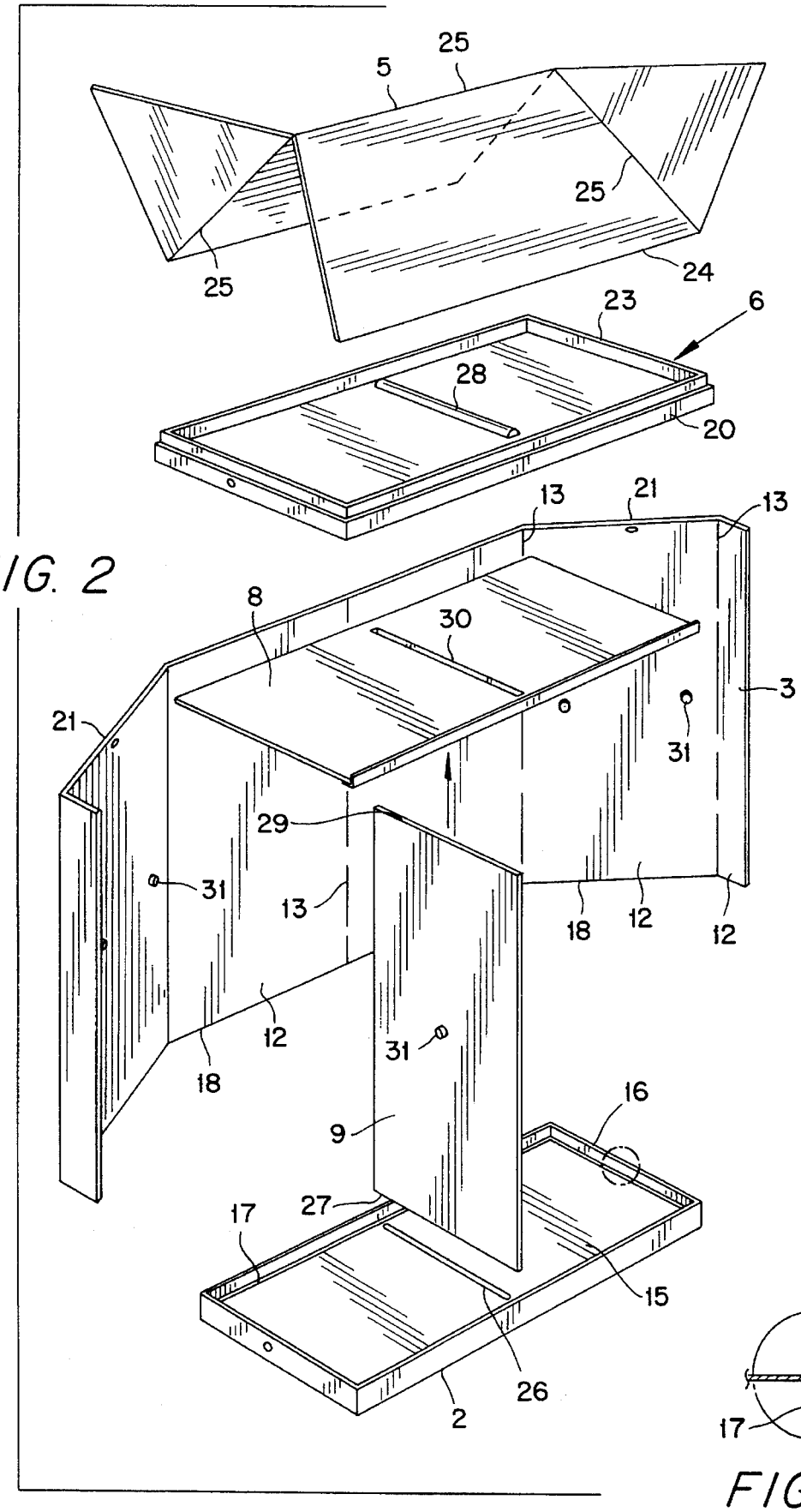
FIG. 2 shows an exploded view of the various components of the doll's house separate from each other.
Figure 2A:
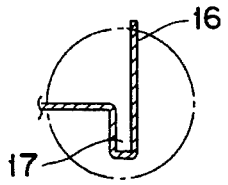
FIG. 2A is a sectional view of a fragment of a base which is circled in FIG. 2.

The house 1 is collapsible into a compact unit and for this purpose the pitched part 5 of the roof 4 is separable from the lid 6, the walls 3 are separable from both the lid 6 and the base 2, and the internal partitions 8 and 9 are separable from each other and from the lid 6 and base 2. The manner of this collapsible arrangement is shown in FIG. 2. As shown, the wall 3 is formed as a single unit but is divided into a series of panels indicated at numeral 12 which are joined together by fold lines 13 which enable the wall 3 to be folded out into its rectangular configuration as shown in FIG. 1 but also allows it to be folded into a collapsed condition which will fit within the base 2. The base 2, it will be noted, has a floor part indicated at numeral 15 and an upstanding flange 16 which extends around the periphery of the floor part 15. A groove 17 is defined just inside of the flange 16, that groove 17 being shown clearly in the enlarged detail in FIG. 2. The lower edge 18 of the wall 3 locates in that groove 17 when the wall is in its erected condition and is frictionally held within that groove 17 to ensure that the structure is relatively stable.

In a similar fashion, the lid 6 has a downwardly extending flange 20 which will locate a round upper edge 21 of the walls when the structure is in its erected condition. The lid 6 has a groove (not shown) just inside of the flange 20 and the upper edge 21 of the walls fits neatly within that groove and is frictionally held within the groove. It will be noted in FIG. 2 of the drawings that the groove in the lid forms a ridge 23 which extends around the periphery of the lid 6 and that ridge 23 engages with the lower edge 24 of the pitched part 5 of the roof when in its erected condition. It will be noted that the pitched part 5 is also formed of a single sheet of material which is foldable along fold lines 25 into its erected and its collapsed conditions. When folded flat the pitched part 5 is able to fit neatly within the base part 2.

The base 2 has a central groove 26 within which the lower edge 27 of the vertical partition 9 locates when the structure is in its erected condition. The lid 6 has a similar groove as indicated at numeral 28 and the upper edge 29 of the vertical partition 9 locates in that groove 28. The horizontal partition 8 has a central slot 30 therein through which the vertical partition 9 will pass when in the erected condition. A stop member 31 on the vertical partition 9 prevents the horizontal partition 8 sliding past the midway point of the vertical partition 9. Stop numbers 31 are also provided on the wall 3 to support the ends of the horizontal partition 8.

Figure 3:
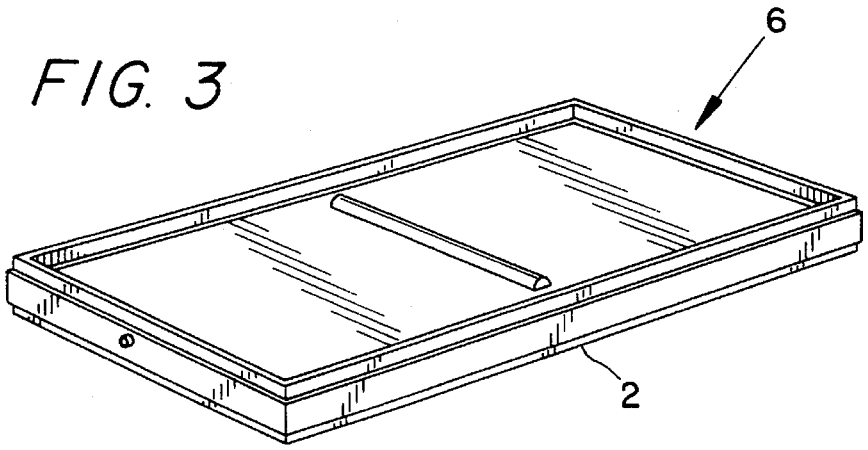
FIG. 3 shows a doll's house in its folded-away condition.

It is thus clear that when the structure is collapsed all of the components will disassemble from one other and all of the components will fit within the base 2. That is, the wall 3 will fold along fold lines 13 into a flat collapsed form which will fit neatly within the flanges 16 of the base 2. When the wall 3, pitched part 5 of the roof, and internal partitions are neatly located within the base 2, the lid 6 will be fitted over the base 2 so that the flanges 20 extend around and over the flanges 16 to thereby form a box and contain all of the other components within that box. The box is shown in FIG. 3 of the drawings and it will be noted that it is a flat compact box which will be easily stowed under a bed, on top of a cupboard, or in any other suitable location. The lid and base will connect together in some convenient fashion. Clips or ties may be provided or the two components may simply frictionally engage with each other.

The doll's house con be made of any suitable material. Particularly, the base and lid part may be formed of an ABS plastics material. The pitched part of the roof and the walls and the internal partitions may be formed of a corrugated polypropylene material. Alternatively, the walls and internal partitions could be made of a natural fibre cardboard material. It is envisaged that the internal side of the walls will have room designs printed thereon whereas the outside of the walls will have a design representing the exterior of the house printed thereon. Quite clearly, other plastics materials and indeed other materials could be used for forming a doll's house according to the invention. In addition, the doll's house does not need to be formed in exactly the same configuration as represented in the illustrations since other designs and forms are also possible.

I claim:

1. A collapsible doll's house comprising:

walls formed from a first one-piece sheet of material which is foldable along a plurality of fold lines to allow the walls to be folded between erected and collapsed configurations, in the erected configuration, the walls being oriented vertically and having upper and lower ends, the fold lines being oriented vertically, and the walls angled relative to one another about the fold lines, in the collapsed configuration, the walls being folded about the fold lines to lie upon one another in parallel planes;

a floor having a base panel and an upwardly extending flange formed around an outer periphery of the base panel for locating and supporting lower portions of the walls when the first sheet is in its erected configuration, and a wall locating groove formed in the base panel inwardly of the flange for frictionally receiving the lower ends of the walls;

a ceiling member having a ceiling panel formed of a thin planar material with a downwardly extending flange formed around an outer periphery of the ceiling panel, the ceiling member being mounted on the upper ends of the walls when the first sheet is in its erected configuration, with the downwardly extending flange locating the upper ends of the walls, the ceiling panel having a lower surface with a wall locating groove formed therein inwardly of the flange of the ceiling panel for frictionally receiving the upper ends of the walls, the wall locating groove forming an upwardly extending ridge on an upper side of the ceiling panel, the ridge extending around the periphery of the ceiling panel and forming a roof locating structure;

a roof formed of a second one-piece sheet of material including a plurality of fold lines to define a pair of major roof panels and a pair of end panels, the second sheet being foldable about the fold lines thereof between pitched and collapsed configurations, in the pitched configuration the roof being supported on the ceiling member and held in position by the roof locating structure thereof, and the major panels and end panels being angled relative to one another about the fold lines of the second sheet, in the collapsed configuration the major panels and end panels being folded about the fold lines of the first sheet and to lie upon one another in parallel planes; and at least one internal dividing partition for dividing the interior of the doll's house into distinct rooms;

the first and second sheets when in their respective collapsed configurations being capable of being stored, together with the partition, on the base panel and within the upwardly extending flange thereof;

the upwardly and downwardly extending flanges of the floor and ceiling member, respectively, being adapted to mate, one within the other, to form a closed box for containing the stored sheets and partition.

2. The collapsible doll's house according to claim 1, wherein the internal dividing partition comprises an operatively vertical panel having lower and upper ends and the ceiling and floor each have a groove adapted to receive the upper and lower ends of the dividing partition, respectively.

3. The collapsible doll's house according to claim 1, wherein the major roof panels are trapezoidal in shape and the end panels are triangular in shape.

* * * * *